US008931305B2

(12) United States Patent
Styles et al.

(10) Patent No.: US 8,931,305 B2
(45) Date of Patent: Jan. 13, 2015

(54) EVAPORATOR UNIT

(75) Inventors: Bryan Styles, Livonia, MI (US); Kwangtaek Hong, Ann Arbor, MI (US); Bradley Brodie, Milford, MI (US)

(73) Assignee: DENSO International America, Inc., Southfield, MI (US)

( * ) Notice: Subject to any disclaimer, the term of this patent is extended or adjusted under 35 U.S.C. 154(b) by 989 days.

(21) Appl. No.: 13/008,219

(22) Filed: Jan. 18, 2011

(65) Prior Publication Data

US 2011/0239697 A1 Oct. 6, 2011

Related U.S. Application Data

(60) Provisional application No. 61/319,778, filed on Mar. 31, 2010.

(51) Int. Cl.
*F25B 41/00* (2006.01)

(52) U.S. Cl.
USPC ..... 62/513; 62/524

(58) Field of Classification Search
CPC ..... F25B 5/02; F25B 40/00; F25B 49/00; F25B 2400/13; F25B 2500/222; F25B 45/00; A23G 9/225
USPC ..... 62/524, 513, 224, 515, 129, 126
See application file for complete search history.

(56) References Cited

U.S. PATENT DOCUMENTS

| | | | | |
|---|---|---|---|---|
| 5,065,595 | A * | 11/1991 | Seener et al. | 62/212 |
| 5,597,117 | A * | 1/1997 | Watanabe et al. | 236/92 B |
| 6,185,957 | B1 * | 2/2001 | Voss et al. | 62/513 |
| 6,298,687 | B1 * | 10/2001 | Dienhart et al. | 62/513 |
| 2002/0121100 | A1 * | 9/2002 | Yabuki et al. | 62/228.1 |
| 2004/0112073 | A1 | 6/2004 | Ito et al. | |
| 2006/0137860 | A1 | 6/2006 | Prasher | |
| 2007/0039351 | A1 | 2/2007 | Bai | |
| 2007/0107887 | A1 | 5/2007 | Muto et al. | |
| 2008/0035319 | A1 | 2/2008 | Vogel | |
| 2008/0202157 | A1 | 8/2008 | Hirota | |
| 2009/0139253 | A1 | 6/2009 | Yanagi et al. | |

FOREIGN PATENT DOCUMENTS

| | | |
|---|---|---|
| DE | 19805285 | 8/1999 |
| DE | 10060114 | 6/2001 |
| EP | 2187150 | 5/2010 |
| FR | 2916835 | 12/2008 |
| JP | 02-8656 | 1/1990 |

(Continued)

OTHER PUBLICATIONS

Office Action dated Aug. 9, 2012 in the corresponding Korean Patent Application No. 10-2011-0026050 with English translation thereof.

(Continued)

*Primary Examiner* — Mohammad M Ali
(74) *Attorney, Agent, or Firm* — Harness, Dickey & Pierce, P.L.C.

(57) ABSTRACT

An evaporator unit comprising an evaporator, an internal heat exchanger defining a high pressure flow passage and a low pressure flow passage, an expansion device connected downstream of the high pressure flow passage of the internal heat exchanger and upstream of the evaporator. The internal heat exchanger is attached to the evaporator. With the above structure, the internal heat exchanger can utilize the remaining cooling capability of the refrigerant exiting from the evaporator for its greatest benefit.

9 Claims, 15 Drawing Sheets

(56) References Cited

FOREIGN PATENT DOCUMENTS

| | | |
|---|---|---|
| JP | 07-294063 | 11/1995 |
| JP | H10-141822 | 5/1998 |
| JP | 10-325652 | 12/1998 |
| JP | 2001-021234 | 1/2001 |
| JP | 2007-155268 | 6/2007 |
| KR | 10-1999-0069449 | 9/1999 |
| KR | 10-2005-0025369 | 3/2005 |

OTHER PUBLICATIONS

Office Action issued Feb. 12, 2014 in corresponding JP Application No. 2011-056674 (with English translation).

Office Action issued Dec. 17, 2012 in corresponding German Patent Application No. 102011014408.0 with English translation.

Office Action dated Sep. 2, 2014 in corresponding Japanese Patent Application No. 2011-056674 with English translation.

* cited by examiner

EVAPORATOR UNIT

CROSS-REFERENCE TO RELATED APPLICATIONS

This application claims the benefit of U.S. Provisional Patent Application No. 61/319,778, filed on Mar. 31, 2010. The entire disclosure of the above application is incorporated herein by reference.

FIELD

The present disclosure relates to an evaporator unit, which is applied to a vapor compression cycle having an internal heat exchanger.

BACKGROUND

This section provides background information related to the present disclosure, which is not necessarily prior art. FIG. 19 depicts a schematic view of a vapor compression cycle, such as an air conditioning cycle or refrigeration cycle, in accordance with the prior art. More specifically, a compressor 2 may compress a working fluid such as a refrigerant into a high pressure gas and force it into a condenser 4, where heat is removed from the gas phase refrigerant in an attempt to further lower the temperature of the compressed refrigerant. The gas phase refrigerant is condensed to a liquid phase refrigerant, exits condenser 4 and proceeds to pass through a high pressure flow passage 6 of an internal heat exchanger 7 where the liquid phase refrigerant is further cooled by using the cool refrigerant that exits from the evaporator 10. Upon passing through the internal heat exchanger 7, the compressed liquid refrigerant passes through a thermostatic expansion valve ("TXV") 8 that controls the amount of refrigerant flow into an evaporator 10 thereby controlling the superheat at the outlet of evaporator 10. In controlling the amount of superheat exiting evaporator 10, a temperature detecting device 12 may be used to adjust an amount of refrigerant entering evaporator 10. The temperature detecting device 12 is commonly integrated into the structure of TXV 8. Upon passing temperature detecting device 12, refrigerant then passes into a low pressure flow passage 14 of the internal heat exchanger 7. The high pressure flow passage 6 is located next to the low pressure flow passage 14, such that refrigerant passing through the high pressure flow passage 6 expels heat that is absorbed by refrigerant passing through the low pressure flow passage 14. Upon exiting the low pressure flow passage 14, refrigerant enters compressor 2 where it is again compressed.

The above vapor compression cycle has proven satisfactory for its intended purpose, but a need exists for improvement of its efficiency.

SUMMARY

In order to improve efficiency, the present disclosure describes an evaporator unit comprising an evaporator, an internal heat exchanger defining a high pressure flow passage, and low pressure flow passage, an expansion device connected downstream side of the high pressure flow passage of the internal heat exchanger and upstream side of the evaporator. The internal heat exchanger and the evaporator maybe integrated to create one assembly. With the above structure, the internal heat exchanger may utilize the remaining cooling capability of the refrigerant just exiting from the evaporator as much as possible. In contrast, if the internal heat exchanger is disposed apart from the evaporator, the refrigerant exiting from the evaporator would absorb heat from the ambient atmosphere, and the internal heat exchanger could not utilize the cooling capability as much as it could. So, the efficiency of the entire vapor compression cycle is improved by the structure described above, relative to vapor compression cycles known in the art.

In another aspect of this disclosure, the evaporator may employ a first tank, a second tank, and a plurality of tubes which interconnect the first tank and the second tank. The plurality of tubes may define a heat exchange surface along their longitudinal side, and the internal heat exchanger may be attached to a side surface of the evaporator. The evaporator side surface may be perpendicular to the heat exchange surface. The internal heat exchanger may reside over the first and second tanks. With the above structure, the evaporator unit is compact.

In another aspect of this disclosure, both the inlet port and the outlet port of the refrigerant flow passage may be disposed on the side surface of the evaporator. With the above structure, the internal heat exchanger can directly communicate with the inlet port and the outlet port.

In another aspect of this disclosure, the inlet port and the outlet port may both be disposed on the first tank. With the above structure, the internal heat exchanger can make the high pressure flow direction opposite from the low pressure flow direction.

In another aspect of this disclosure, the expansion device may be a thermostatic expansion device having a temperature sensing element and a diaphragm. The temperature sensing element may be attached to the outlet port. With the above structure, the evaporator unit may control the phase of the refrigerant just before the compressor.

In another aspect of this disclosure, the thermostatic expansion device may employ a chamber accommodating the diaphragm and a means for connecting the temperature sensing element and the chamber. The evaporator unit may further employ a means for insulating heat between the internal heat exchanger and the means for connecting the temperature sensing element and the chamber. With the above structure, the evaporator unit may detect the temperature of the refrigerant more exactly.

In another aspect of this disclosure, the internal heat exchanger may employ a connecting tank which may be divided into a first connecting space and a second connecting space by a division wall. Said first connecting space may communicate with the high pressure flow passage, the second connecting space may communicate with the low pressure flow passage, and one of the high pressure flow passage and low pressure flow passage, penetrates the other's connecting space and the division wall to reach its respective connecting space. With the above structure, the internal heat exchanger can locate high pressure flow passage more close to the low pressure flow passage using a simple structure.

Further areas of applicability will become apparent from the description provided herein. It should be understood that the description and specific examples are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
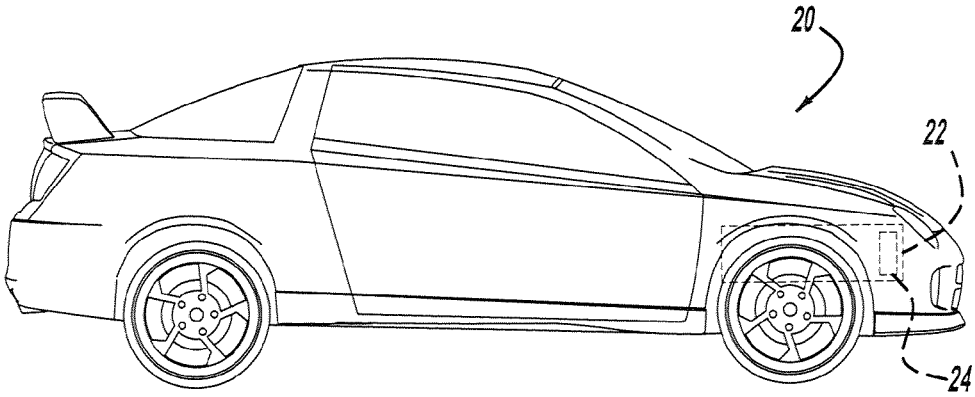
FIG. 1 is a side view of a vehicle depicting a location of an engine and a vapor compression cycle in accordance with the present disclosure.
Figure 2:
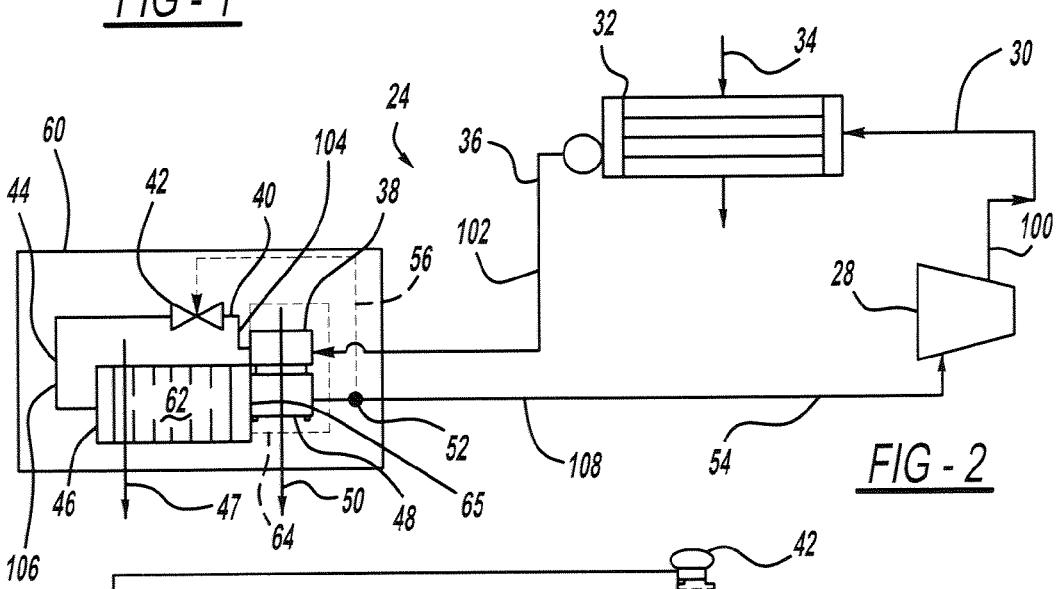
FIG. 2 is a schematic view of a vapor compression cycle in accordance with a first embodiment.
Figure 3:
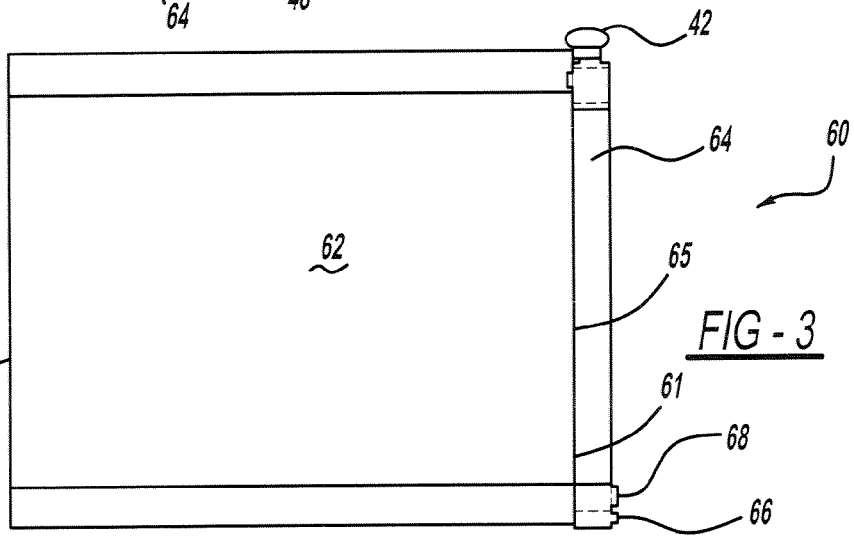
FIG. 3 is a front view of an evaporator unit, including an evaporator, an internal heat exchanger, and TXV in accordance with the first embodiment.
Figure 4:
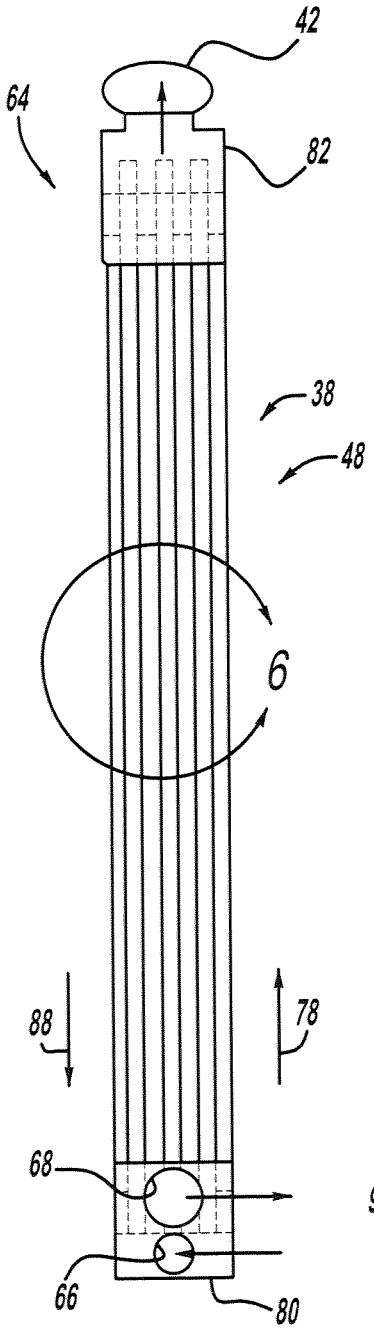
FIG. 4 is a side view of an internal heat exchanger and TXV in accordance with the first embodiment.
Figure 5:
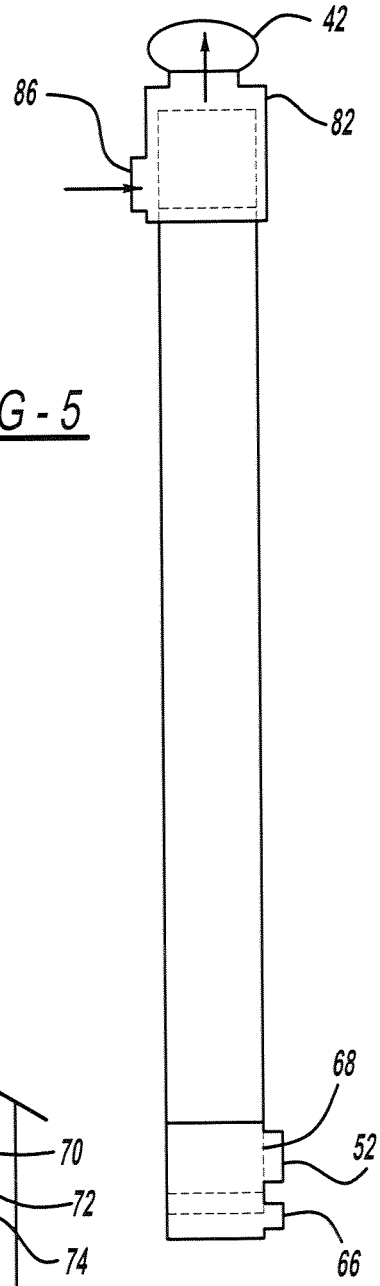
FIG. 5 is a side view of the internal heat exchanger in accordance with the first embodiment.

With reference to FIGS. 1-7 of the accompanying drawings, details of the first embodiment of the present disclosure will be described. FIG. 1 is a side view of vehicle 20 depicting a location of an engine 22 and a vapor compression cycle 24, such as an air-conditioning cycle in accordance with the present disclosure. The air-conditioning cycle also extends back into the dash-covering area between the engine compartment and vehicle cabin. Turning now to FIG. 2, vapor compression cycle 24 may begin at a compressor 28 where a refrigerant such as, but not limited to, R134a, R1234yf or R-744 may be compressed into a high temperature, superheated, vapor state. In the case of a subcritical refrigerant, the super-heated, vapor refrigerant is then forced into line 30 en route to a condenser 32. Upon passing into condenser 32, refrigerant expels or relinquishes heat to air 34 flowing through a core of condenser 32. During relinquishment of heat to air 34, compressed refrigerant maintains pressure but changes phase to a dual phase, liquid and vapor, refrigerant. Upon exiting condenser 32, the refrigerant may become partially or completely liquid. The refrigerant may then be forced through line 36 before passing into high pressure flow passage 38, which will be discussed shortly. Upon passing out of high pressure flow passage 38, liquid refrigerant then moves into line 40 and subsequently a thermostatic expansion valve ("TXV") 42 or may be passed from high pressure flow passage 38 to TXV 42. Upon passing out of TXV 42, the previously highly compressed refrigerant expands into line 44 or be passed directly from TXV 42 into evaporator 46, having a core 62. Such expansion upon the refrigerant passing out of the TXV 42 causes a relatively large drop in pressure and temperature. Upon passing into evaporator 46, the refrigerant may again be in a dual, liquid and vapor phase or state, and is heated by air 47 passing through evaporator 46. Upon passing out of evaporator 46, vaporous refrigerant may pass immediately into low pressure flow passage 48 which, as will be explained later, is integrated with high pressure flow passage 38 and evaporator 46. High pressure flow passage 38 and low pressure flow passage 48 constitute an internal heat exchanger 64. Heat exchanger 64 and evaporator 46 are integrated to create one assembly (i.e. evaporator unit 60). More specifically, internal heat exchanger 64 is attached to a mounting portion 65 of evaporator 46. Mounting portion 65 is provided by one of a side wall 61 of evaporator 46. Side wall 61 is disposed adjacent to core 62. Upon immediately passing out of internal heat exchanger 64 and into line 54, a temperature of refrigerant is measured using a temperature-sensing device 52, which communicates via a communication line 56 with TXV 42. Temperature-sensing device 52 may also be attached or connected to an outlet 68, as depicted in FIG. 5. Vaporous refrigerant then passes from line 54 into compressor 28, which completes a vapor-compression cycle and permits the refrigerant to undergo another vapor compression cycle.

In accordance with the present disclosure, FIG. 3 depicts a single, unitary evaporator unit 60. The internal heat exchanger 64 in this embodiment may be a micro channel internal heat exchanger 64.

Figure 6:
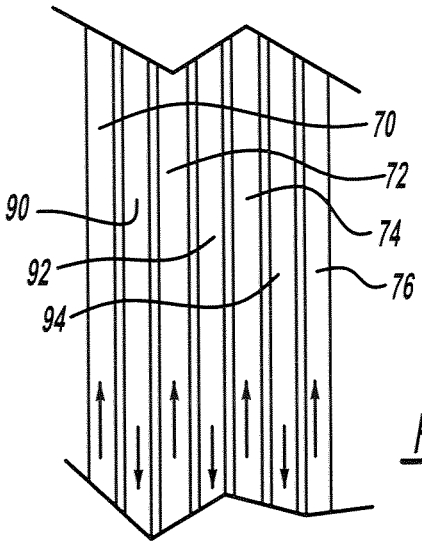
FIG. 6 is an enlarged front view of the internal heat exchanger in accordance with the first embodiment.

FIGS. 4-6 depict enlarged views of internal heat exchanger 64. More specifically, FIG. 4 is a side view depicting an internal heat exchanger inlet 66 and an internal heat exchanger outlet 68. Internal heat exchanger inlet 66 communicates with high pressure flow passage 38. Internal heat exchanger outlet 68 communicates with low pressure flow passage 48. More specifically, inlet 66 may be an inlet that receives relatively high-pressure liquid refrigerant to flow inside of tubes 70, 72, 74, 76 in an upward direction in accordance with arrow 78 from a bottom tank 80 of internal heat exchanger 64 to a top tank 82 of internal heat exchanger 64. Tubes 70, 72, 74 constitute the high pressure flow passage 38. It should be understood that terms such as upward and downward are relative to ground upon which vehicle 20 rests when internal heat exchanger 64 is installed in a vehicle, such as vehicle 20 for example. Upon reaching top tank 82 of internal heat exchanger 64, relatively high-pressure refrigerant passes into TXV 42 to permit expansion of high-pressure refrigerant into evaporator core 62. Upon passing from TXV 42, the expanded refrigerant passes through evaporator core 62 and absorbs heat from the outside air 47. Decompressed or expanded refrigerant again passes into internal heat exchanger 64 at return inlet 86 at a top tank 82 of internal heat exchanger 64. Upon re-entering at top tank 82 at return inlet 86, decompressed refrigerant passes downward through internal heat exchanger in accordance with arrow 88 by passing through tubes 90, 92, 94, and reaches outlet 68. Tubes 90, 92, 94 constitute low pressure flow passage 48. The refrigerant passes from outlet 68 into line 54, and upon flowing through line 54, refrigerant reaches compressor 28. The tubes 70, 72, 74 physically touch to the tubes 90, 92, 94. In this embodiment, the high pressure flow passage 38 comprises 4 tubes, and the low pressure flow passage 48 comprises 3 tubes. Alternatively, due to the relative refrigerant densities, the low pressure flow passage 48 may comprise 4 tubes, and the high pressure flow passage 38 may comprise 3 tubes.

Figure 19:
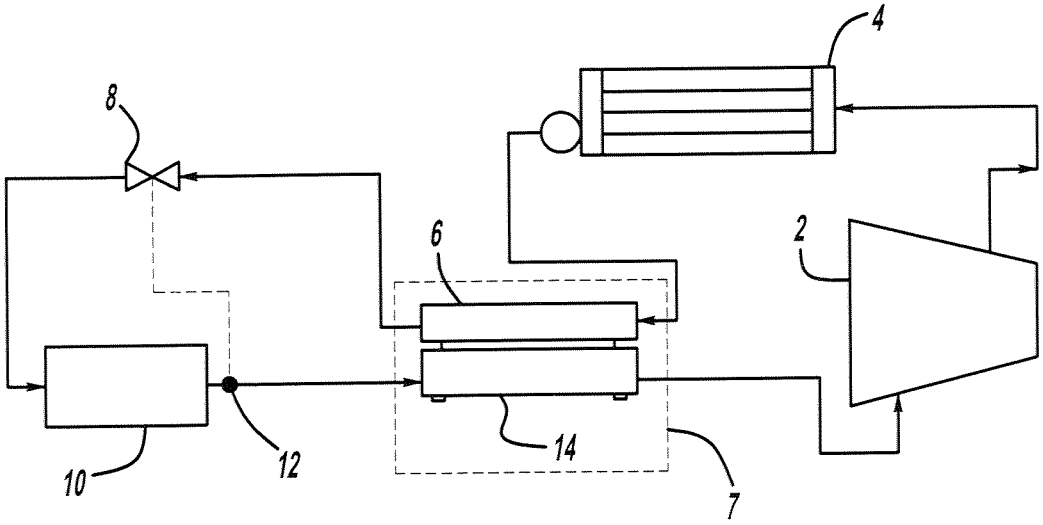
FIG - 19 Prior Art
FIG. 19 is a schematic view of a vapor compression cycle in accordance with the prior art.

With reference to FIG. 3, an advantage of the present disclosure is that evaporator unit 60 allows vapor compression cycle 24 to use the cooling capacity of the refrigerant just flowing out from evaporator 46 as much as it can. So, with evaporator unit 60 in this embodiment, total fuel efficiency is improved, relative to the conventional vapor compression cycle depicted in FIG. 19. With reference to FIG. 4, another advantage of the present disclosure is that when liquid refrigerant exits low pressure flow passage 48 at top tank 82 and enters TXV 42, it will have benefited from being further cooled by low-pressure refrigerant that is lower in temperature and that enters internal heat exchanger 64 at return inlet 86. Such entering refrigerant subsequently moves downward through internal heat exchanger tubes 90-94 to absorb heat form the upwardly moving, higher pressure, higher temperature refrigerant moving through tubes 70-76 that is exiting internal heat exchanger 64 at top tank 82, as depicted with FIGS. 4 and 6. When exiting refrigerant is further heated in such a manner, the refrigerant that is returned to the compressor 28 may be in a superheated, vaporous state which is controlled by TXV 42 using the temperature sensing device 52 such as temperature sensing bulb 52, which improves compressor efficiency and may extend the useful life of compressor 28. Other advantages of the present disclosure are the improved packaging of the vapor-compression system into the vehicle, reduced refrigerant charge amount, parts reduction, improved system controllability/stability, improved efficiency, and improved system durability. Improved packaging and refrigerant charge amount reduction is the result of a reduction in overall tubing or line length. Parts reduction is achieved through the replacing of a separate heat exchanger (comprised of heat exchangers 6, 14 and evaporator 46) with a single integrated component (i.e. the evaporator unit 60). Improved system controllability/stability is the result of controlling the superheat at locations where the refrigerant has already passed through internal heat exchanger 64 instead of location 12 (depicted in FIG. 19). TXV 42 or 8 (depicted in FIG. 19) meters refrigerant flow more stably when the refrigerant entering it (exiting 48 or 10) has a minimum level of superheat. In the present disclosure, a minimum level of superheat is maintained. However, it can be difficult to achieve this minimum level of superheat in the state of the art since the TXV is often operated very close to the point of refrigerant saturation to maximize the performance through heat exchangers 14, 6. Improved efficiency is also achieved in the present disclosure by controlling the superheat of the refrigerant leaving internal heat exchanger 64. This directly controls the quality of the refrigerant entering compressor 28 and allows for the user to tune the TXV to operate at the optimal point for efficiency. This is contrary to the state of the art where the TXV controls the superheat of the refrigerant entering the internal heat exchanger 64. In the state of the art, the superheat of the refrigerant leaving internal heat exchanger 64 is unknown, meaning that the quality of the refrigerant returning to the compressor is not known. Therefore, the system cannot be fully optimized for efficiency. Improved durability is also derived from this fact. If the quality of the refrigerant leaving the internal heat exchanger 64 is not known, then the system may allow refrigerant with not enough superheat or refrigerant with too much superheat to return to the compressor 28. This would result in either liquid refrigerant returning to the compressor 28 or refrigerant that is too hot (too much superheat) returning to the compressor 28. Both of these scenarios result in reduced compressor 28 life and can lead to premature failure of the system shown in FIG. 19.

With reference to FIG. 6, high pressure flow passage 38 (i.e. combination of the micro-channel tubes 70-76) may have a combined free flow area in the range of but not limited to 20 $mm^2$-85 $mm^2$. Low pressure flow passage 48 (i.e. the micro-channel tubes 90, 92, 94) may have a combined free flow area in the rage of, but not limited to, 140 $mm^2$-420 $mm^2$. Stated differently, the ratio of free-flow areas should be between 1.6-21.0 for the free-flow area of tubes 90-94 relative to the free-flow area of tubes 70-76.

Figure 7:
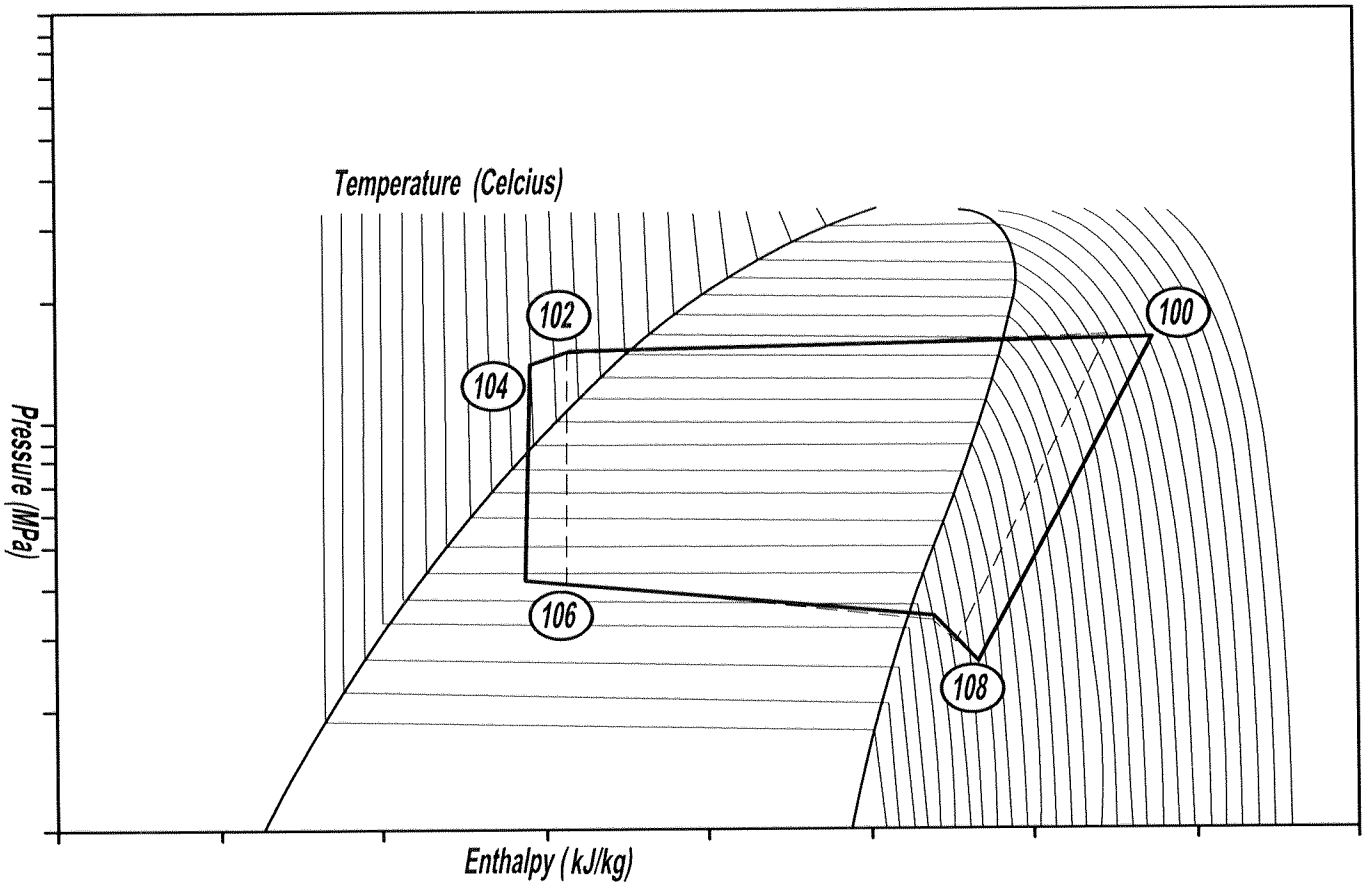
FIG. 7 is a graph of pressure verses enthalpy versus temperature in accordance with the first embodiment.

FIG. 7 is a graphical representation a Pressure (MPa) versus Enthalpy (kJ/Kg) versus Temperature (Celsius) that demonstrates an advantage of evaporator unit 60. With reference first to FIG. 2, various stages throughout vapor compression cycle 24 are indicated. For instance, reference numeral 100 of FIG. 2 represents a position immediately after compressor 28 and corresponds to position 100 of FIG. 7 which depicts a superheat or vapor region of vapor compression cycle 24. Reference numeral 102 of FIG. 2 represents a position immediately after condenser 32 and corresponds to position 102 of FIG. 7 which depicts a sub-cooled, liquid region of vapor compression cycle 24. Reference numeral 104 of FIG. 2 represents a position immediately after heat exchanger 38 and corresponds to position 104 of FIG. 7 which depicts a further sub-cooled, liquid region of vapor compression cycle 24. Reference numeral 106 of FIG. 2 represents a position immediately after TXV 42 and corresponds to position 106 of FIG. 7 which depicts a dual phase region of liquid and vapor of vapor compression cycle 24. Reference numeral 108 of FIG. 2 represents a position immediately after heat exchanger 48 and corresponds to position 108 of FIG. 7 which depicts a superheated or vapor region of vapor compression cycle 24.

Figure 8:
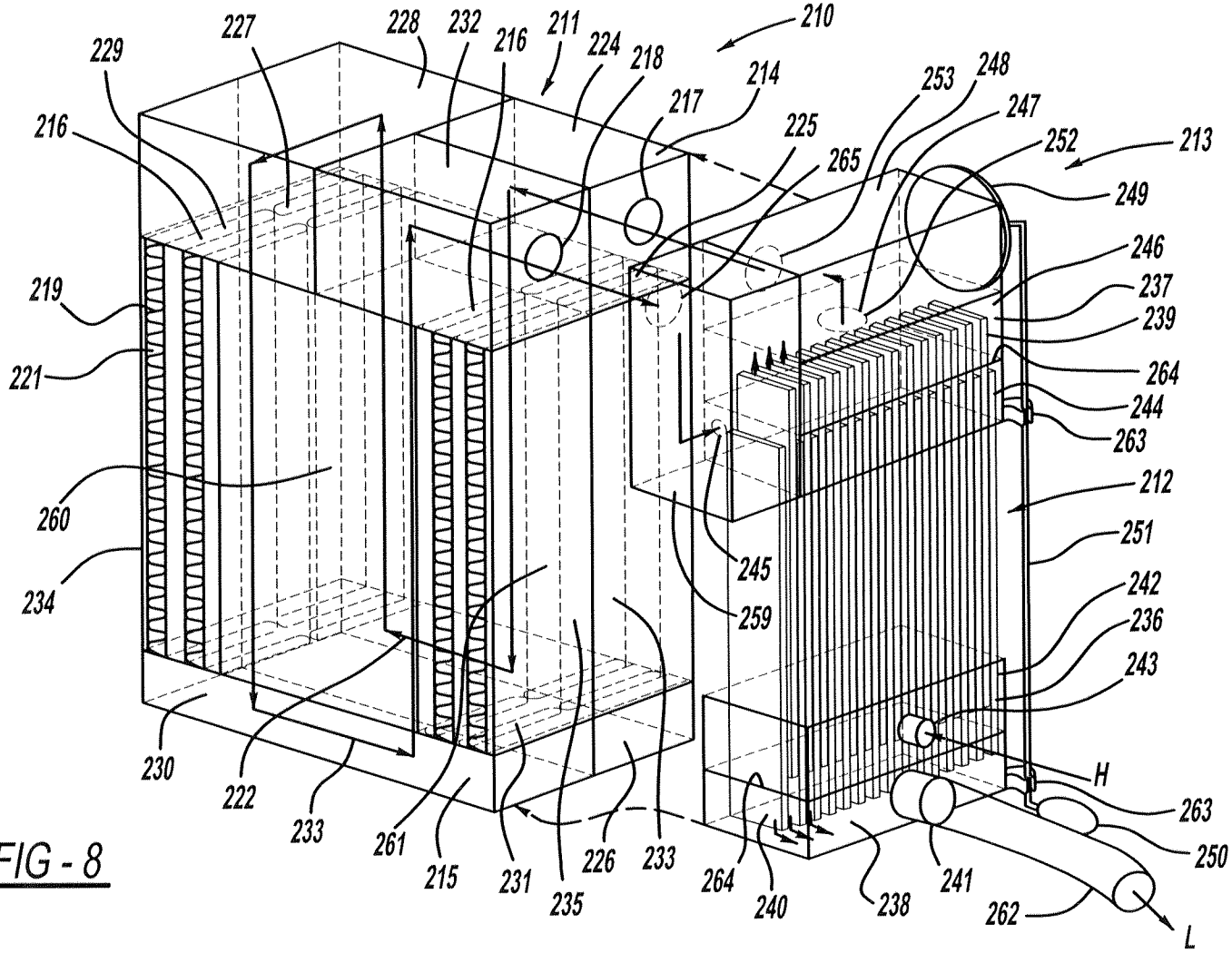
FIG. 8 is an exploded view of an evaporator unit in accordance with a second embodiment.

FIG. 8 shows an evaporator unit 210 according to the second embodiment. The difference between the first embodiment and the second embodiment may be evaporator unit 210. The remaining components may be the same as the first embodiment described above.

Evaporator unit 210 may employ evaporator 211, internal heat exchanger 212 and TXV 213. Evaporator 211, internal heat exchanger 212 and TXV 213 may be attached to each other to constitute an integrated unit.

Evaporator 211 may employ a first tank 214, a second tank 215 and a plurality of tubes 216. First tank 214 may be provided with both an inlet 217 of evaporator 211 and an outlet 218 of evaporator 211. In this embodiment, first tank 214 may be disposed in the upper side of evaporator 211. First tank 214 and second tank 215 may be connected to each other by the plurality of tubes 216. There may be corrugate fins 219 between tubes 216. Tubes 216 and corrugate fins 219 may define heat exchange core 220. Heat exchange core 220 may have air gaps 221 that air passes through. Heat exchange core 220 may be composed by stacking tubes 216 and corrugate fins 219. So, when the refrigerant passes through tubes 216, the refrigerant exchanges heat with the air passing through the air gap 221.

In this embodiment, first tank 214 may be divided into at least two parts. One part is connected to inlet 217 of evaporator 211. The other part may be connected to outlet 218 of evaporator 211. Both parts may communicate with corresponding tubes 216 for distributing the refrigerant to, and collecting the refrigerant from, the corresponding tubes 216.

Second tank 215 forms U-turn portions 222, 223 of the refrigerant flow pass, which lead the refrigerant from inlet 217 of evaporator 211 to outlet 218 of evaporator 211.

More specifically, first tank 214 may be divided into three parts. Each part may be connected to corresponding tubes 216. On the other hand, second tank 215 may be divided into two parts in this embodiment.

First part 224 of first tank 214 communicates with inlet 217 of evaporator 211. Then, first part 224 of first tank 214 may distribute the refrigerant to corresponding tubes 216 (first tubes 225), which may be connected to first part 226 of second tank 215. The refrigerant flowing into first part 226 of second tank 215 may be distributed to tubes 216 (second tubes 227), which may be connected to second part 228 of first tank 214. The refrigerant flowing into second part 228 of first tank 214 may be distributed to tubes 216 (third tubes 229), which may be connected to second part 230 of second tank 215. The refrigerant flowing into second part 230 of second tank 215 may be distributed to tubes 216 (fourth tubes 231), which may be connected to third part 232 of first tank 214. The refrigerant flowing into the third part 232 of first tank 214 may lead to outlet 218 of evaporator 211.

In this embodiment, first part 226 and second part 230 of second tank 215 provide U-turn portions 222, 223 of the refrigerant flow pass. Also, second part 228 of first tank 214 provides another U-turn portion of the refrigerant flow pass.

First part 224 of first tank 214 may be disposed next to the third part 232 of first tank 214. Inlet 217 and outlet 218 of evaporator 211 may face the same side of first tank 214. As a result, the refrigerant flow passage is provided in the arrow direction depicted in FIG. 8.

Evaporator 211 may further employ side walls 233, 234, which may be disposed to or at the stacking end portion of said heat exchange core 220. Side wall 233 has a mounting portion 235, to which internal heat exchanger 212 may be attached.

Internal heat exchanger 212 may employ first connecting tank 236, second connecting tank 237, a high pressure flow passage 239, and low pressure flow passage 240.

First connecting tank 236 may have a multi-level, multi-floor structure similar to a two story building structure. First floor 238 of first connecting tank 236 has a low pressure refrigerant outlet 241 of internal heat exchanger 212, and second floor 242 of first connecting tank 236 may have a high pressure refrigerant inlet 243 of internal heat exchanger 212.

Second connecting tank 237 may also have a multi-level, multi-floor structure similar to a two story building structure. First floor 244 of second connecting tank 237 may have a low pressure refrigerant inlet 245 as part of internal heat exchanger 212, and second floor 246 of second connecting tank 237 may have a high pressure refrigerant outlet 247 as part of internal heat exchanger 212.

High pressure flow passage 239 and low pressure flow passage 240 are stacked together, and enabled to exchange heat between high pressure refrigerant and low pressure refrigerant therein. In this embodiment, each length of high pressure flow passage 239 and each length of low pressure flow passage 240 may be the same and high pressure flow passage 239 and low pressure flow passage 240 may be shifted or exchanged with each other with regard to a refrigerant flow direction.

High pressure flow passage 239 connecting second floor 242 of first connecting tank 236 and second floor 246 of second connecting tank 237. High pressure flow passage 239 penetrates first floor 244 of second connecting tank 237.

Low pressure flow passage 240 connects first floor 238 of first connecting tank 236 and the first floor of second connecting tank 237. The low pressure flow passage 240 penetrates second floor 242 of first connecting tank 236.

Outlet 218 of evaporator 211 may be connected to low pressure refrigerant inlet 245 of internal heat exchanger 212 via a third connecting tank 259. Inlet 217 of evaporator 211 may be connected to high pressure refrigerant outlet 247 of internal heat exchanger 212 via TXV 213.

TXV 213 may employ housing portion 248 accommodating an orifice portion 254 (depicted in FIG. 9), an operating portion 249 accommodating a diaphragm 258 (depicted in FIG. 9) connected to the orifice portion 254, and temperature detecting element 250 detecting the temperature of the refrigerant.

In this embodiment, temperature detecting element 250 may detect the temperature of the refrigerant flowing out from high pressure refrigerant outlet 247 of internal heat exchanger 212. TXV 213 may further employ a connection pipe 251 connecting temperature detecting element 250 and operating portion 249. Connection pipe 251 may lead inside pressure of temperature detecting element 250 to operating portion 249. Connection pipe 251 may be thermally insulated from internal heat exchanger 212 by air gap defined between connection pipe 251 and high and low pressure flow passages 239, 240.

Figure 9:
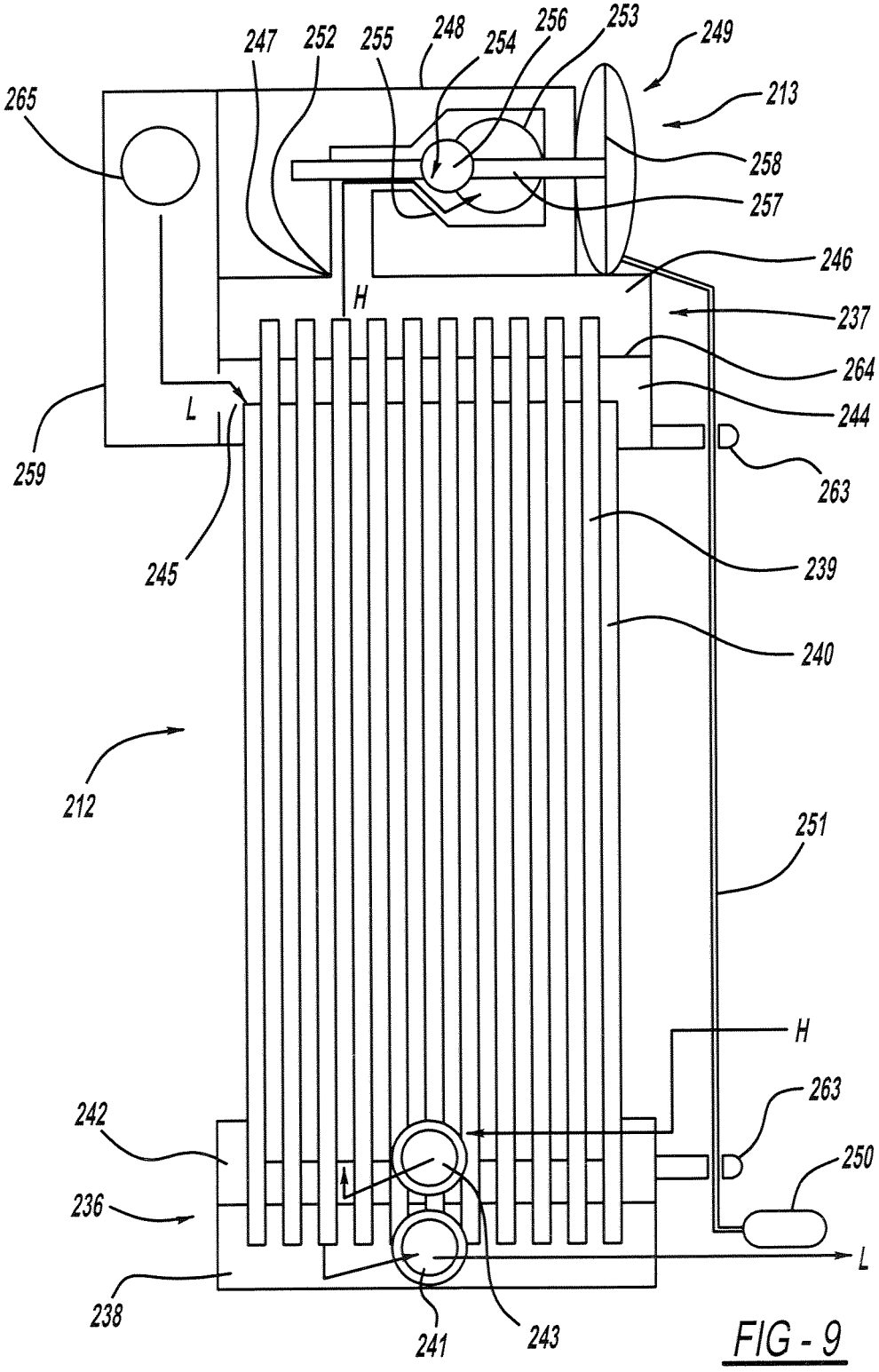
FIG. 9 is a cross sectional view of the internal heat exchanger and TXV in accordance with the second embodiment.

FIG. 9 is a side cross sectional view of internal heat exchanger 212 and TXV 213 in the second embodiment, as seen from a side opposite evaporator side. TXV 213 is located on the upper surface of internal heat exchanger 212. TXV 213 may employ a housing portion 248, an operating portion 249 and a temperature detecting element 250. Housing portion 248 has an inlet hole 252 communicating with outlet 253 of TXV 213 via an orifice portion 254. Orifice portion 254 may employ a valve seat 255 and ball shaped valve 256. Ball shaped valve 256 may be operated by operating rod 257. Operating rod 257 may be connected to and may be actuated by a diaphragm 258. Diaphragm 258 is accommodated in operating portion 249, and operating portion 249 actuates operating rod 257 based on the temperature detected by temperature detecting element 250. In this embodiment, internal heat exchanger 212 is connected to outlet 218 of evaporator 211 via a third connecting tank 259. Third connecting tank 259 is disposed next to second connecting tank 237 and housing portion 248 of TXV 213. Inlet 265 of third connecting tank 259 is connected to outlet 218 of evaporator 211. In this embodiment, internal heat exchanger 212 may be provided with a certain structure described above, which can divide different temperature, two-flow passages, each into a plurality of smaller fluid passages. Such a structure may enable the plurality of smaller fluid passages to exchange their heat having different temperatures with each other. Then, the structure may gather or combine the same kinds of fluid passages into one original flow passage.

In this embodiment, evaporator 211 defines the refrigerant flow passage (depicted in FIG. 8), inlet port 217 and outlet port 218 of evaporator 211. Internal heat exchanger 212 defines high pressure flow passage 239, into which relatively high pressure refrigerant flows, and low pressure flow passage 240, into which low pressure refrigerant from outlet port 218 of evaporator 211 flows. Expansion device 213 may be connected to a downstream side of high pressure flow passage 239 of internal heat exchanger 212 and upstream side of the inlet port 217 of evaporator 211. Internal heat exchanger 212 may be attached to evaporator 211 to comprise evaporator unit 210.

According to the above structure, evaporator unit 210 allows the vapor compression cycle to use the cooling capacity of the refrigerant flowing out from evaporator 211 as much as possible. So, with evaporator unit 210 in this embodiment, total efficiency of the vapor compression cycle is improved.

Also in this embodiment, evaporator 211 may employ a first tank 214, a second tank 215, and a plurality of tubes 216 which interconnect first tank 214 and second tank 215. The plurality of tubes 216 define a heat exchange surface 260 along their longitudinal side. Internal heat exchanger 212 may be attached to a side surface 261 of evaporator 211. Side surface 261 may be perpendicular to the heat exchange surface 260. Internal heat exchanger 212 may reside over both first tank 214 and second tank 215.

According to the above structure, evaporator unit 210 disposes internal heat exchanger 212 to one of side surfaces where first tank 214 or second tank 215 are not disposed. So, with evaporator unit 210 in this embodiment, the heat exchange surface is located near a center of evaporator unit 210 and that allows evaporator unit 210 to be used in various kinds of refrigeration cycles and improve its packaging.

Also in this embodiment, both inlet port 217 and outlet port 218 of the refrigerant flow passage defined by evaporator 211 are disposed to the same side surface 261 of evaporator 211. So, with evaporator unit 210 in this embodiment, internal heat exchanger 212 can connect both inlet port 217 and outlet port 218 at once.

Also, in this embodiment, inlet port 217 and outlet port 218 are both disposed to or in first tank 214. So, with evaporator unit 210 in this embodiment, heat exchanger 212 allows its high pressure side flow direction in high pressure flow passage 239 to be opposite from its low pressure side flow direction in low pressure flow passage 245.

Also in this embodiment, expansion device 213 is a thermostatic expansion device 213 (TXV 213) having temperature sensing element 250 and diaphragm 258. Temperature sensing element 250 is attached to outlet 241 of low pressure flow passage 240 of internal heat exchanger 212 or attached to a pipe 262 extending from outlet 241 of low pressure flow passage 240 of internal heat exchanger 212. So, with evaporator unit 210 in this embodiment, evaporator unit 210 allows the vapor compression cycle to control the super heat of refrigerant after passing through internal heat exchanger 212 and before being drawn into compressor 28. So, with evaporator unit 210 in this embodiment, the system durability can be improved.

Also in this embodiment, thermostatic expansion valve 213 has connection pipe 251 which is means for connecting temperature detecting element 250 and a chamber accommodating diaphragm 258. Bracket 263 may insulate heat between internal heat exchanger 212 and connection pipe 251. So, with evaporator unit 210 in this embodiment, the amount of heat exchange between internal heat exchanger 212 and connection pipe 251 is reduced. That means thermal expansion device 213 can detect the intended refrigerant temperature more correctly.

Also in this embodiment, second connecting tank 237 is divided into a first connecting space (more specifically, in this embodiment first floor 244 of second connecting tank 237) and a second connecting space (more specifically, in this embodiment second floor 246 of second connecting tank 237) by a division wall 264. First connecting space 244 communicates with low pressure flow passage 240, and second connecting space 246 communicates with high pressure flow passage 239. At least one of high pressure flow passage 239 and low pressure flow passage 240 (more specifically, in this embodiment high pressure flow passage 239) penetrates the other's connecting space 244 and the division wall 264 to reach its respective connecting space 246. So, with evaporator unit 210 in this embodiment, internal heat exchanger 212 allows two kinds of fluid passages to connect a respective tank. The respective tank may adjoin each other, and the fluid passages may reside in the adjoining direction.

In other words, heat exchanger (more specifically, in this embodiment internal heat exchanger 212) may employ a first refrigerant flow passage (more specifically, in this embodiment low pressure flow passage 240), a second refrigerant flow passage (more specifically, in this embodiment high pressure flow passage 239) disposed adjacent to first refrigerant flow passage 240, a connecting tank (more specifically, in this embodiment second connecting tank 237) which is divided into a first connecting space (more specifically, in this embodiment first floor 244 of second connecting tank 237) and a second connecting space (more specifically, in this embodiment second floor 246 of second connecting tank 237). First connecting tank space 244 communicates with first refrigerant flow passage 240. Second connecting tank space 246 communicates with second refrigerant flow passage 239. Second refrigerant flow passage 239 penetrates first connecting space 244 and division wall 264 to reach second connecting space 246.

So, heat exchanger 212 allows two kinds of fluid passages (i.e. first refrigerant flow passage 240 and second refrigerant flow passage 239) to connect respective tank (i.e. first floor 244 and second floor 246 of second connecting tank 237). The respective tank 244 and 246 adjoin, and fluid passages 239, 240 are residing in the adjoining direction.

Figure 10:
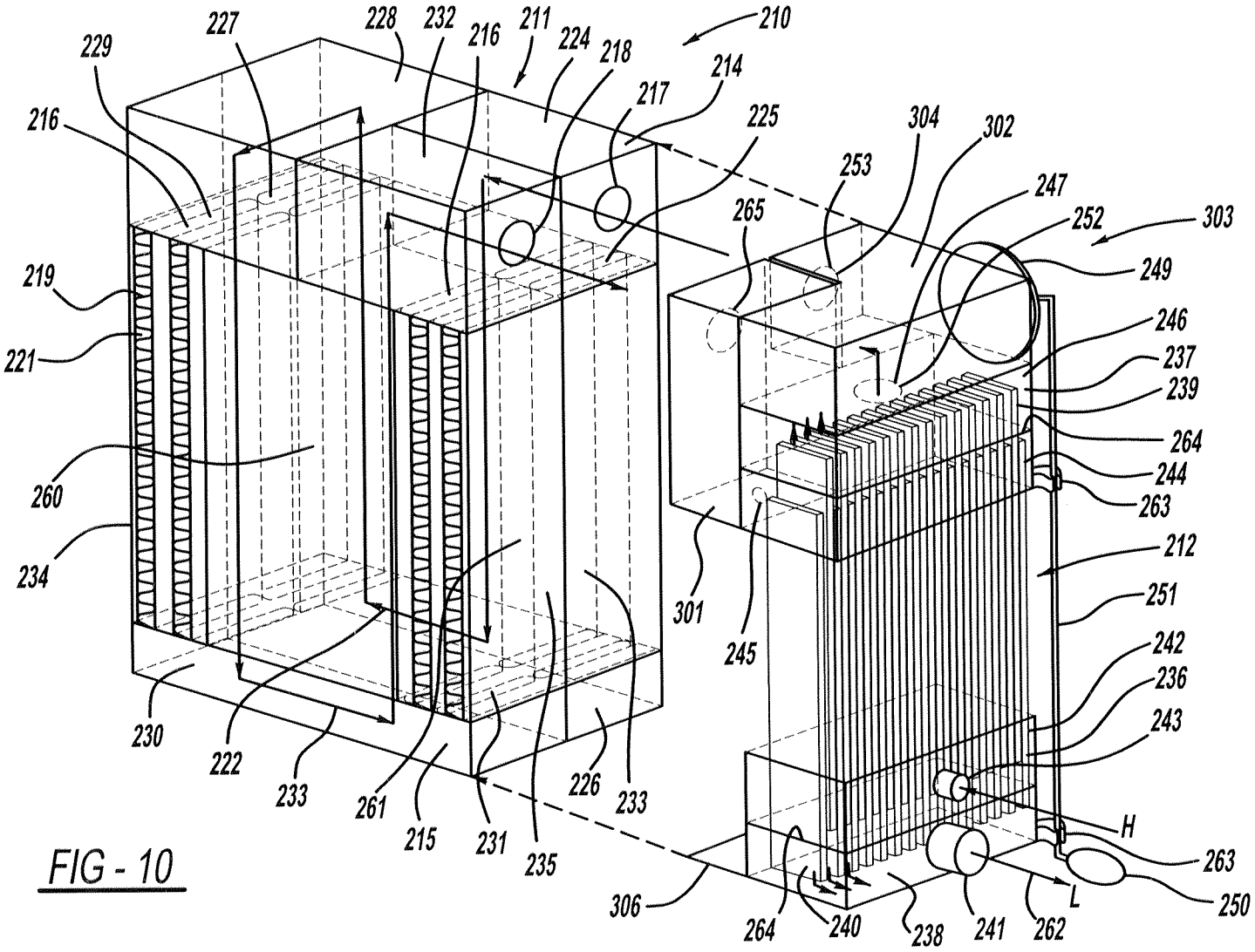
FIG. 10 is an exploded view of an evaporator unit in accordance with a third embodiment.

FIG. 10 shows the exploded view of evaporator unit 300 in the third embodiment. One difference between this embodiment and the second embodiment is a position of a third connecting tank.

In this embodiment, third connecting tank 301 may be disposed between housing portion 302 of TXV 303 and outlet 218 of evaporator 211 (i.e. first tank 214 of evaporator 211).

Third tank 301 is disposed next to first floor 244 of second connecting tank 237 and also next to TXV 303. Third tank 301 provides the flow passage between outlet 218 of evaporator 211 and first floor 244 of second connecting tank 237.

In this embodiment, housing portion 302 of TXV 303 is L-shaped. The L shape provides connecting passage 304 to inlet 217 of evaporator 211.

Figure 11:
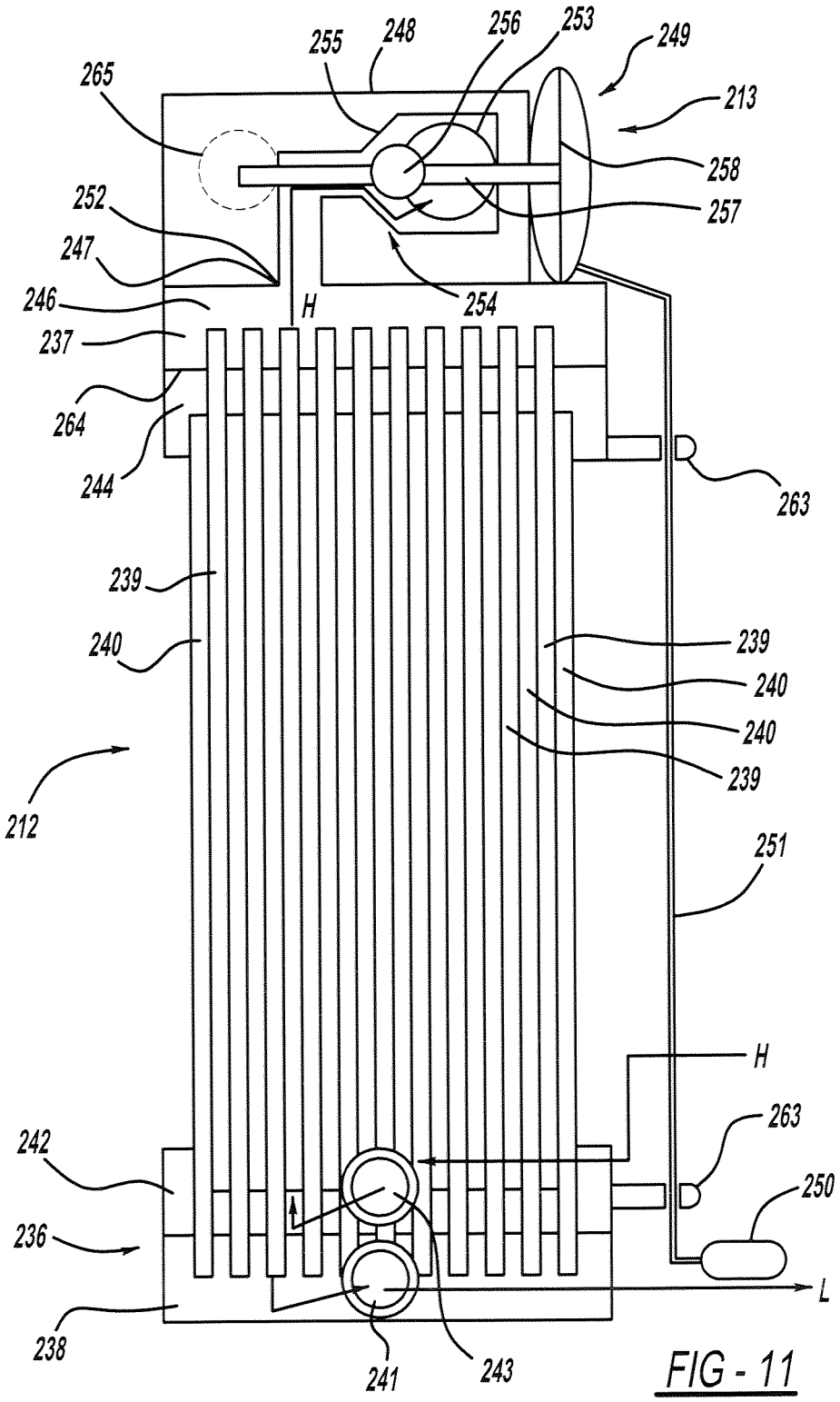
FIG. 11 is a cross sectional view of the internal heat exchanger and TXV in accordance with the third embodiment.

FIG. 11 shows the side cross sectional view of internal heat exchanger 212 and TXV 303 in this embodiment, as seen from a side opposite evaporator 211. The remaining components may be the same as the first embodiment and the second embodiment.

Figure 12:
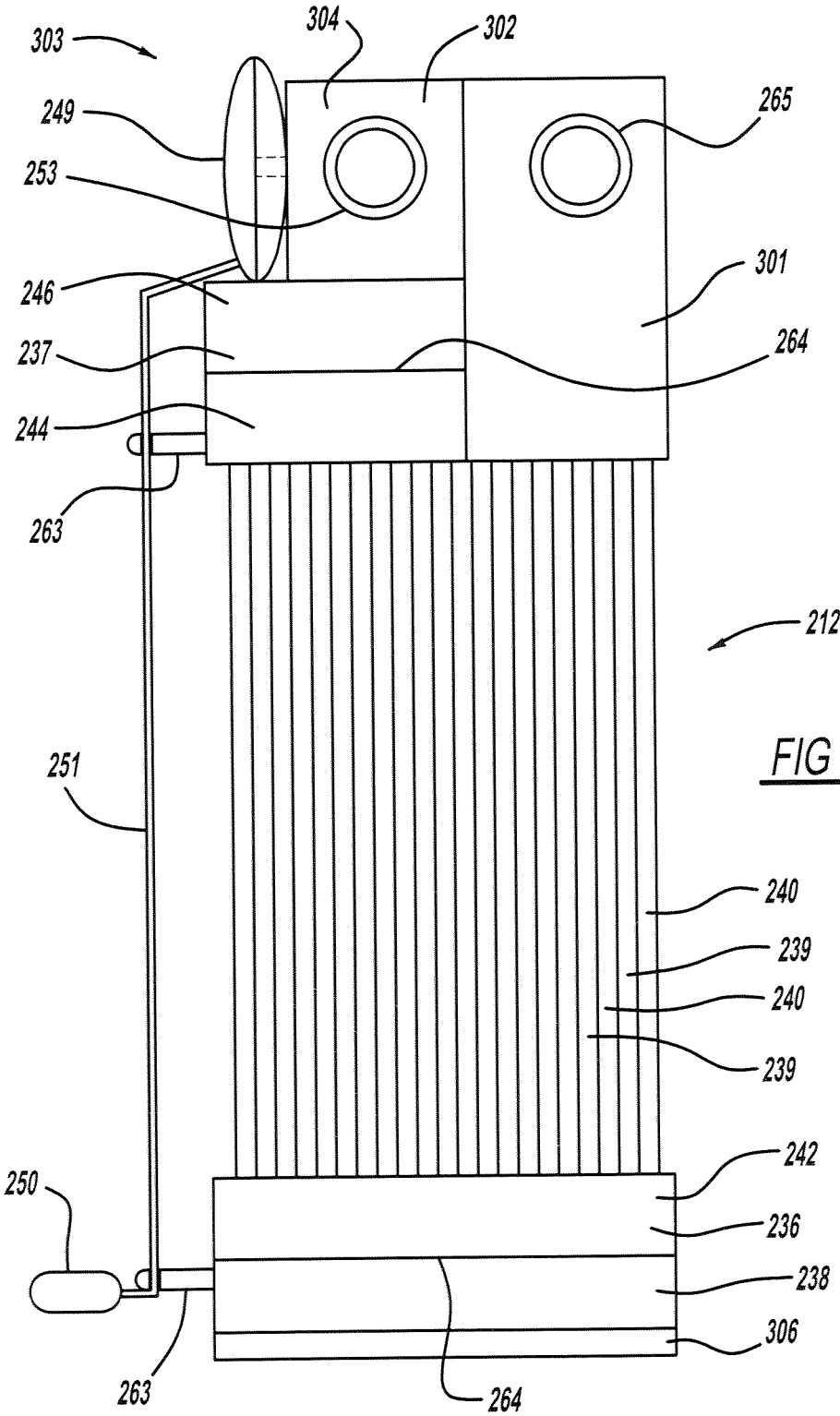
FIG. 12 is a side view of the internal heat exchanger and TXV in accordance with the third embodiment.

FIG. 12 shows a side view of internal heat exchanger 212 and TXV 303, as seen from the side where evaporator 211 is disposed.

Figure 13:
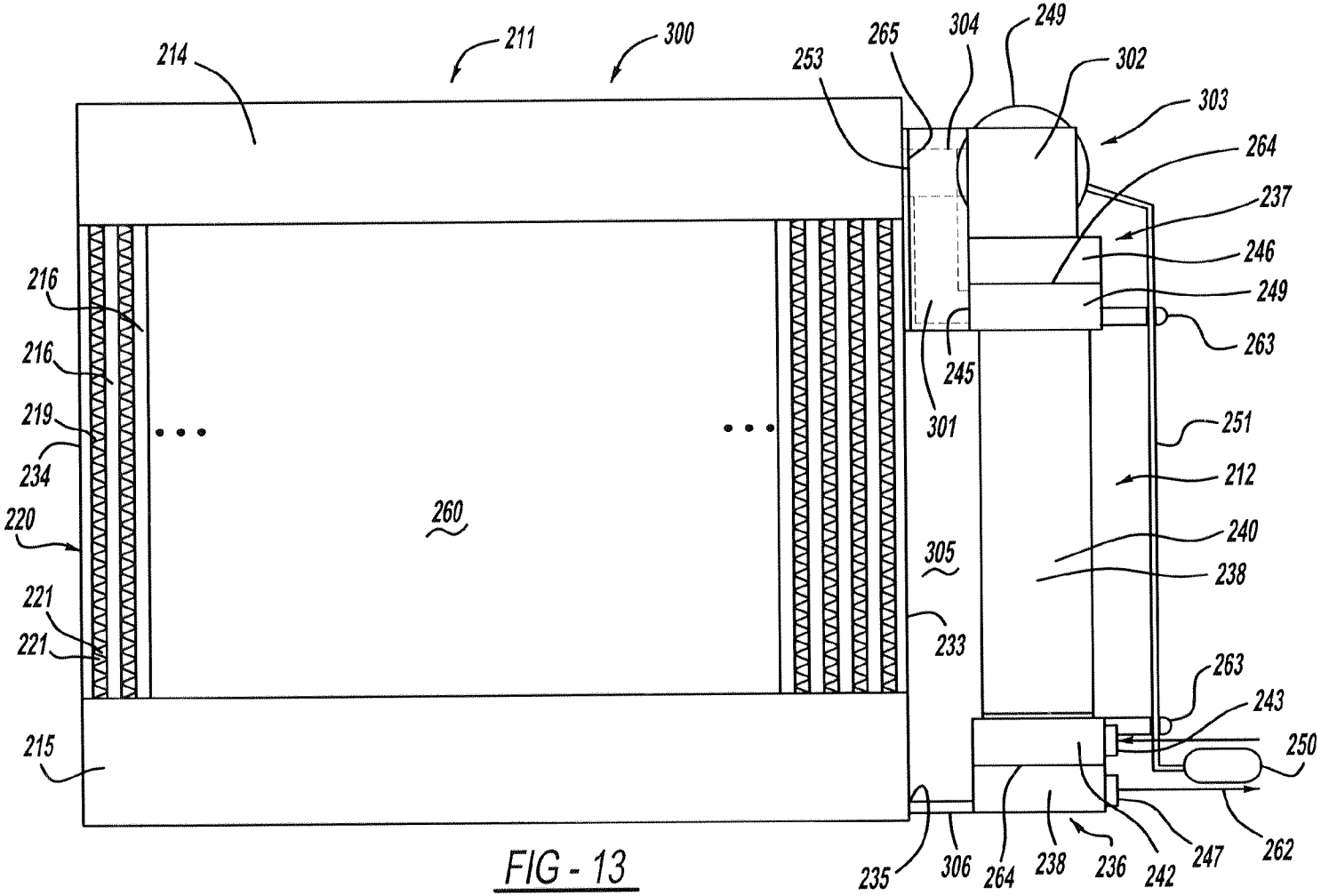
FIG. 13 is a front view of the evaporator unit in accordance with the third embodiment.

FIG. 13 shows the front view of evaporator unit 300 in the third embodiment. In this embodiment, there is a heat insulating gap 305 defined between side wall 233 of evaporator 211 and internal heat exchanger 212. Gap 305 prevents internal heat exchanger 212 from exchanging its heat with evaporator 211.

In this embodiment, first connecting tank 236 of internal heat exchanger 212 and second tank 215 of evaporator 211 are connected by fixing portion 306. The width of third connecting tank 301 and fixing portion 306 defines heat insulating gap 305. With heat insulating gap 305, evaporator unit 300 allows the vapor compression cycle to use the cooling capacity of the refrigerant flowing out from evaporator 211 as much as possible.

Like components relative to the first embodiment and the second embodiment are indicated by like reference numerals. Like components have the same or nearly the same effects.

Figure 14:
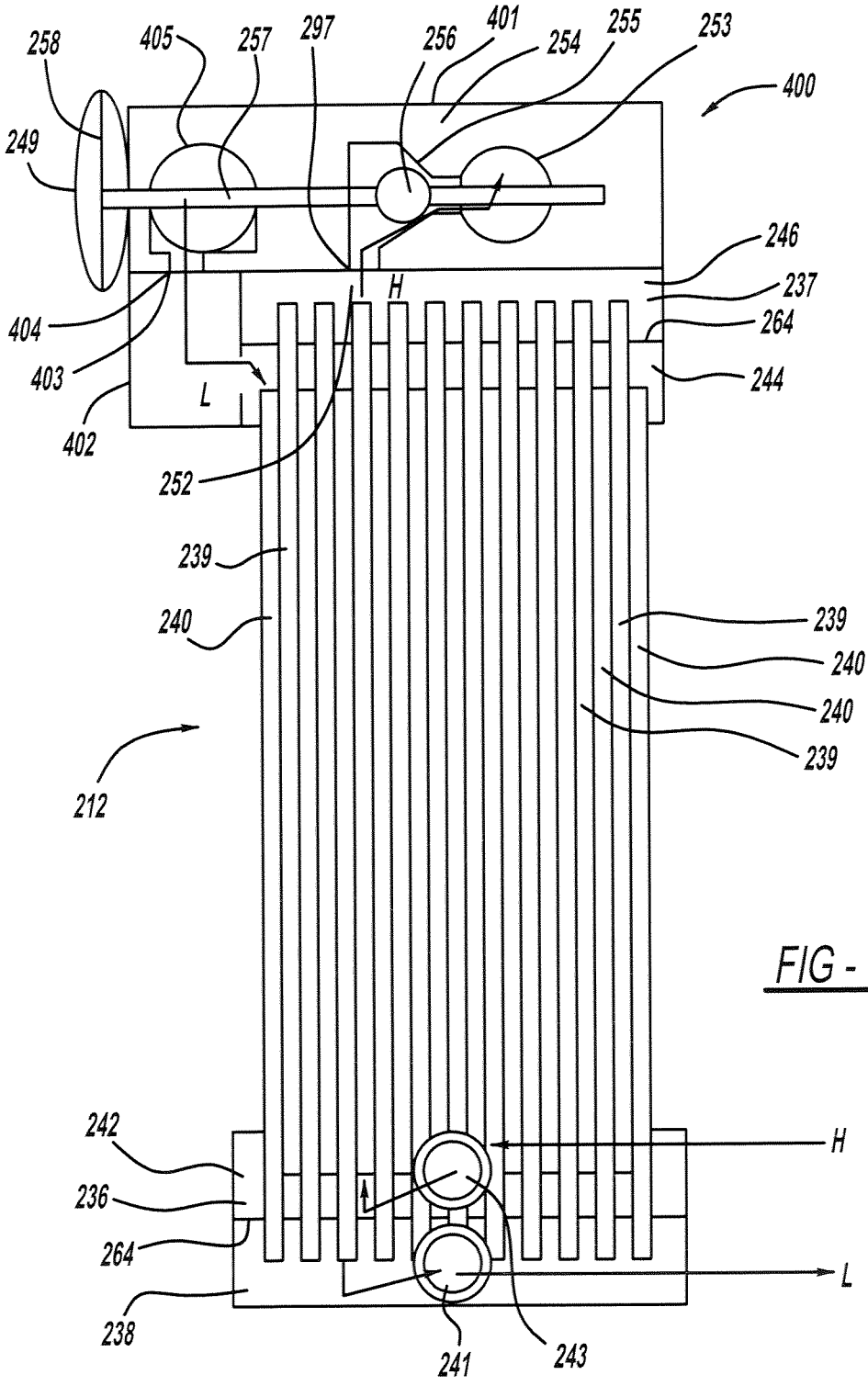
FIG. 14 is a cross sectional view of the internal heat exchanger and TXV in accordance with a fourth embodiment.

FIG. 14 shows the side cross-sectional view of internal heat exchanger 212 and TXV 400 in a fourth embodiment, as seen from a side opposite evaporator 211.

In this embodiment, internal heat exchanger 212 may be connected to outlet 218 of evaporator 211 via Box-type TXV 400 and third connecting tank 402. Housing portion 401 of TXV 400 accommodates the temperature detecting function (i.e. Box-type TXV). Box-type TXV 400 detects the temperature of refrigerant exiting from evaporator 211 via connecting rod 257. Inlet 403 of third connecting tank 402 is connected to low pressure outlet 404 of Box-type TXV 400. Connecting rod 257 is disposed in low pressure refrigerant passage 405 which connects outlet 218 of evaporator 211 and inlet 403 of third connecting tank 402. In this embodiment, Box-type TXV 400 cannot detect the temperature of the refrigerant exiting from outlet 241 of internal heat exchanger 212, but it could eliminate communication pipe 251 and its clamp 263 described above.

Internal heat exchanger 212 may be attached to evaporator 211. The remaining components may be the same as the other embodiments described above and may have the same or similar effect. Like components relative to the embodiments described above, are indicated by like reference numerals.

Figure 15:
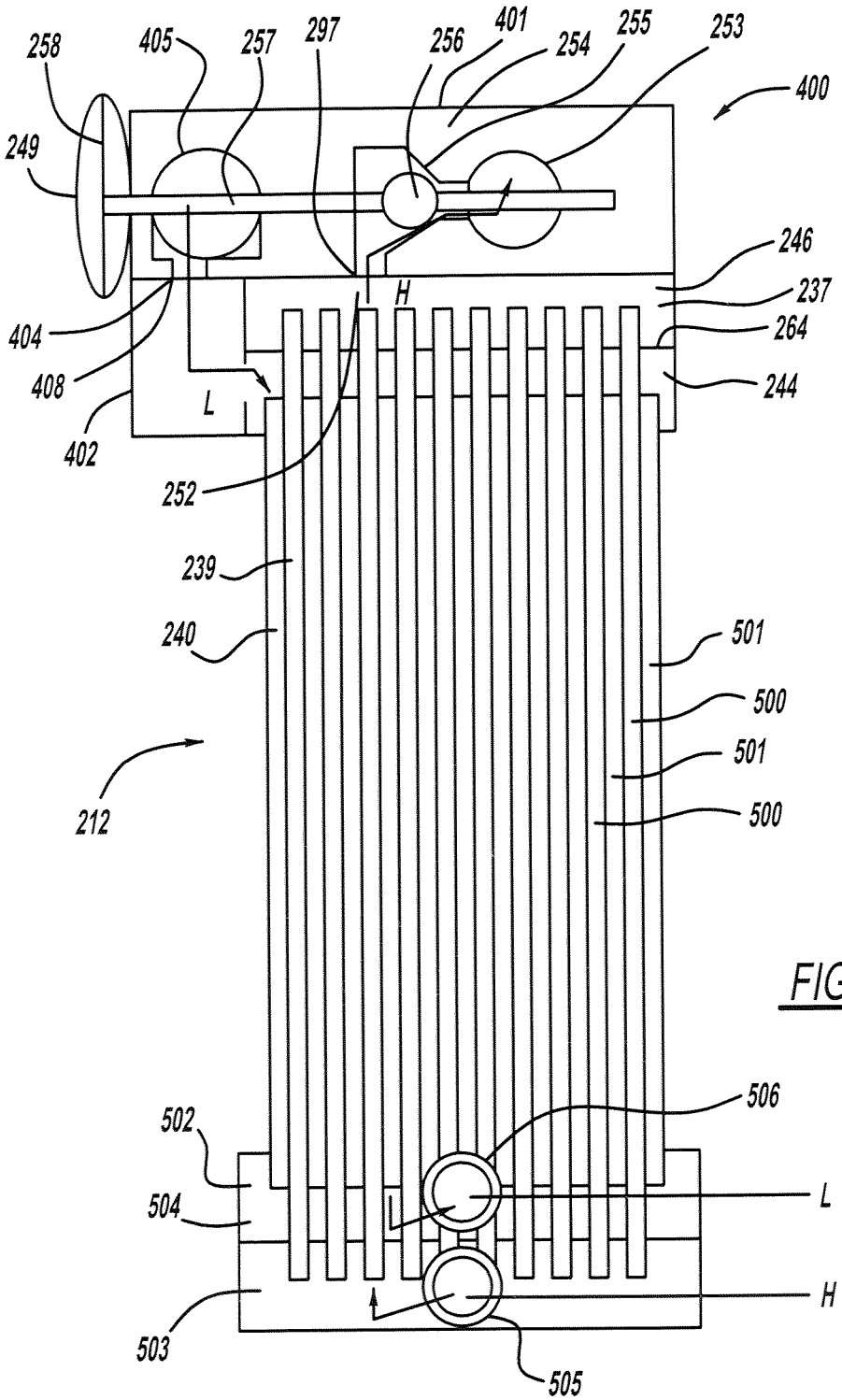
FIG. 15 is a cross sectional view of the internal heat exchanger and TXV in accordance with a fifth embodiment.

FIG. 15 shows the side cross sectional view of internal heat exchanger 212 and TXV 400 in a fifth embodiment, as seen from a side opposite evaporator 211. In the fourth embodiment, high pressure flow passages 239 and low pressure flow passages 240 are the same length.

But in the fifth embodiment, high pressure flow passages 500 and low pressure flow passages 501 are not the same length. High pressure flow passages 500 are longer than low pressure flow passages 501. High pressure flow passages 500 penetrate both division walls 264 of first connecting tank 236 and second connecting tank 237.

First connecting tank 502 of this embodiment is different from other embodiments. First floor 503 of first connecting tank 502 has a high pressure refrigerant inlet 505 of internal heat exchanger 212. Second floor 504 of first connecting tank 502 has a low pressure outlet 506 of internal heat exchanger 212.

Internal heat exchanger 212 may be attached to evaporator 211. The remaining components may be the same as the fourth embodiment and may have the same effect. Like components relative to the embodiments described above, are indicated by like reference numerals.

Figure 16:
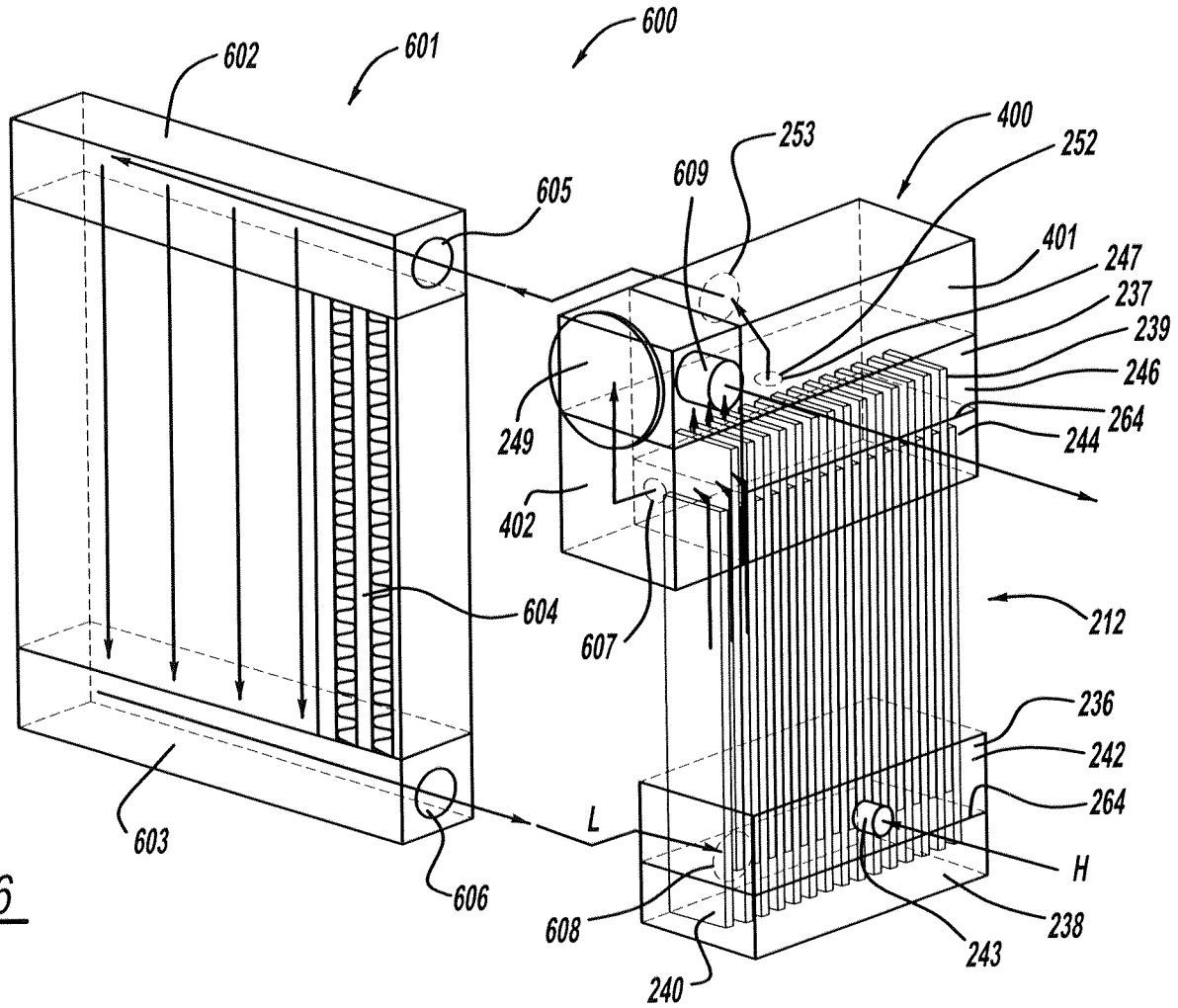
FIG. 16 is an exploded view of the evaporator unit in accordance with a sixth embodiment.

FIG. 16 shows an exploded view of evaporator unit 600 in sixth embodiment. Evaporator 601 in the sixth embodiment differs from evaporator 211 described in the other embodiments.

In this embodiment, evaporator 601 comprises distribution tank 602 and collecting tank 603. Tubes 604 connect distribution tank 602 and collection tank 603. Distribution tank 602 has an inlet port 605 of the evaporator. Collecting tank 603 has an outlet port 606 of evaporator 600.

Internal heat exchanger 212 in this embodiment has a similar structure as that of the fourth embodiment, but the position of low pressure refrigerant outlet 607 of internal heat exchanger 212 is different from the position of low pressure refrigerant outlet 241 of internal heat exchanger 212 of the fourth embodiment.

Also, the flow direction of the low pressure refrigerant flow of internal heat exchanger 212 is opposite from the fourth embodiment, because of a difference in the evaporator structure.

The low pressure refrigerant exiting from evaporator 600 goes into first floor 238 of first connecting tank 236 from low pressure inlet 608. Low pressure outlet 607 of internal heat exchanger 212 is disposed at first floor 244 of second connecting tank 237. The low pressure refrigerant exiting from outlet 607 passes through Box-type TXV 400 and exits from outlet 609 of Box-type TXV 400. Thus, the direction of flow through low pressure refrigerant flow passage 240 is the same as the flow direction of high pressure refrigerant flow passage 239. In this embodiment, Box-type TXV 400 can detect the temperature of the refrigerant which passed through internal heat exchanger 212.

Figure 17:
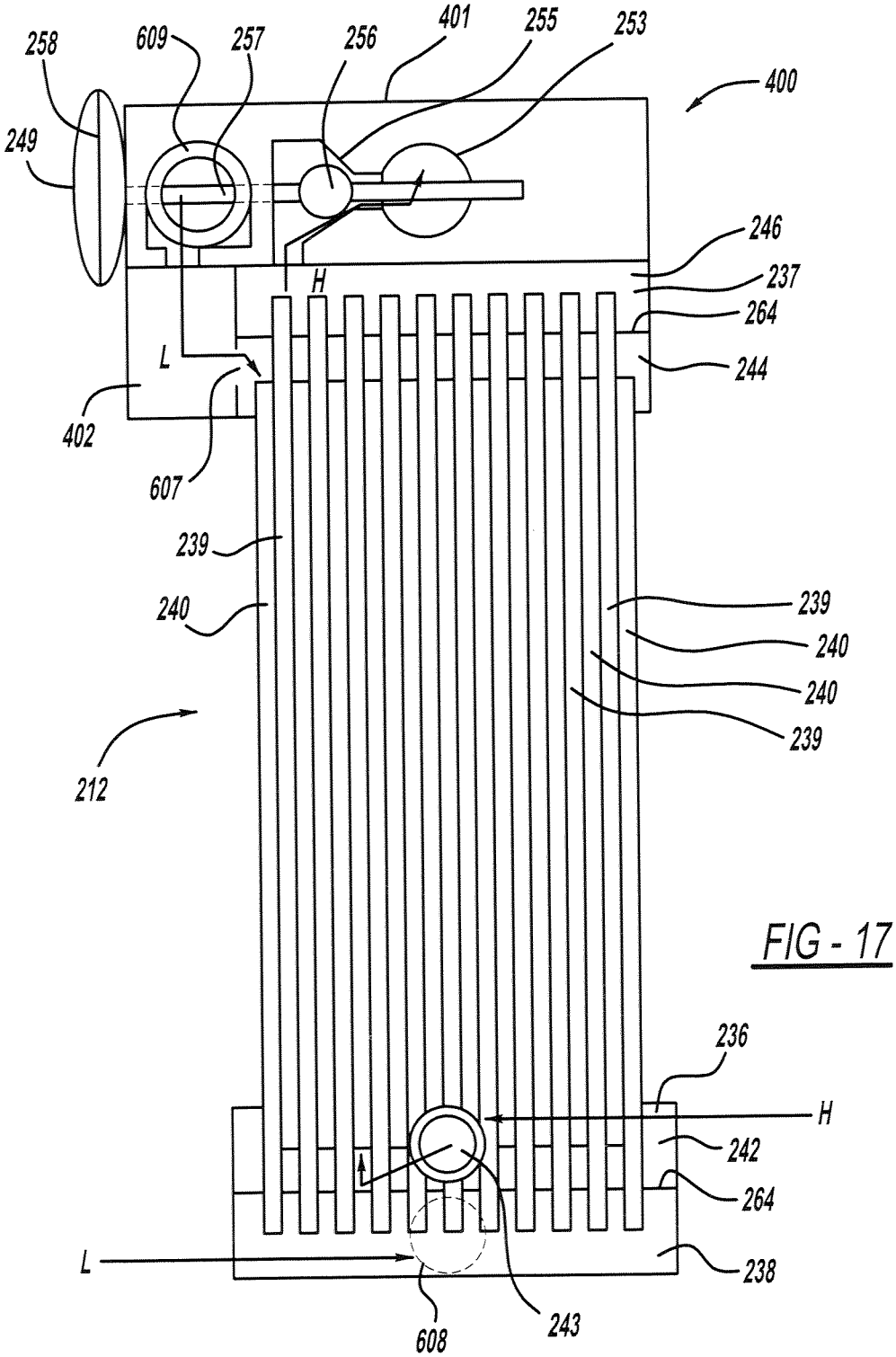
FIG. 17 is a cross sectional view of the internal heat exchanger and TXV in accordance with the sixth embodiment.

FIG. 17 shows a side cross sectional view of internal heat exchanger 212 and TXV 400 in the sixth embodiment, as seen from a side opposite evaporator 600.

Internal heat exchanger 212 may be attached to evaporator 600. Like components may be the same as in the fourth embodiment, and may have the same effects. Like components are indicated by like reference numerals.

Figure 18:
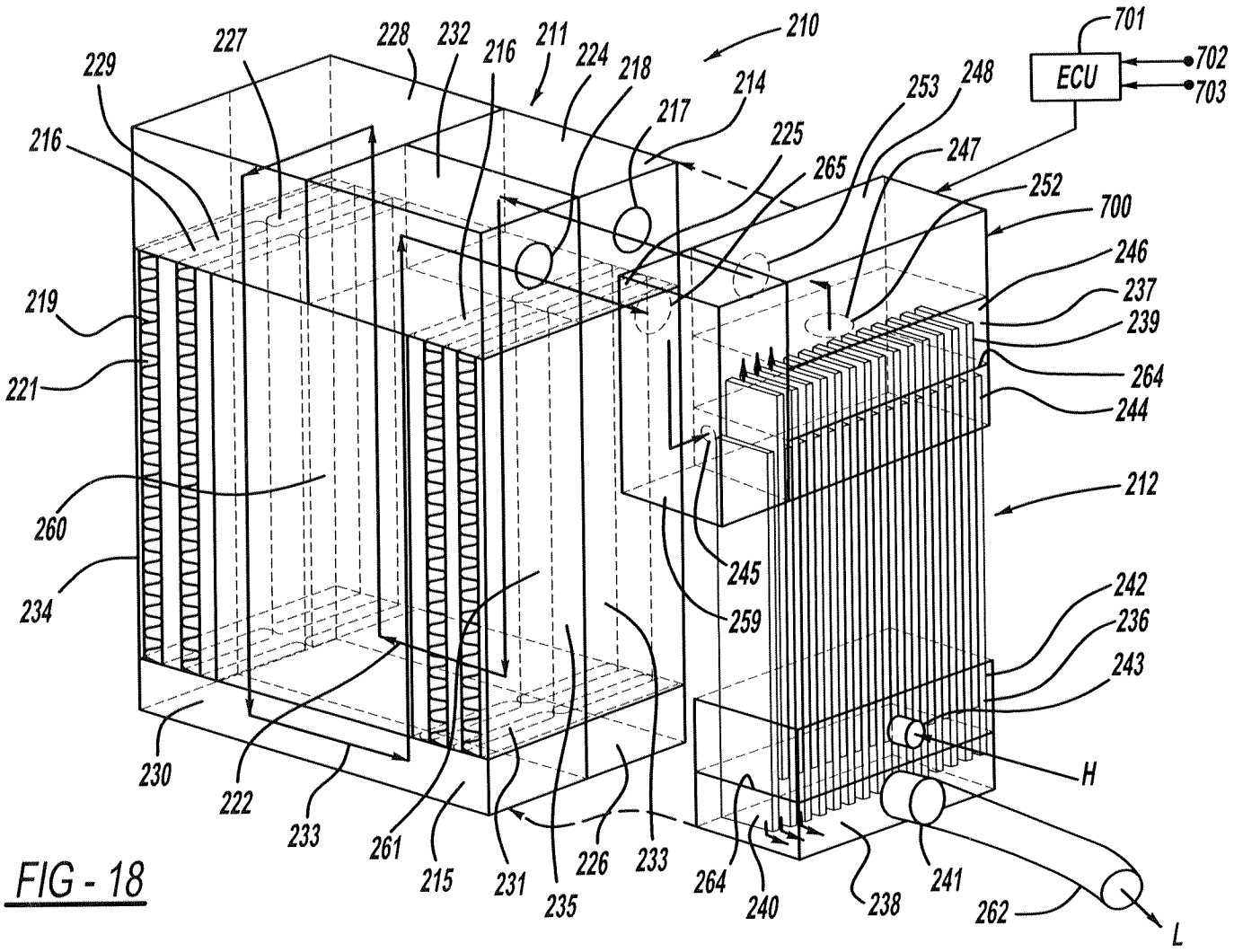
FIG. 18 is an exploded view of the evaporator unit in accordance with a seventh embodiment.

FIG. 18 shows an exploded view of evaporator unit 300 in the seventh embodiment. One difference between this embodiment and the second embodiment is the type of expansion device employed.

In this embodiment, the expansion device may be an electronic expansion valve 700, which may be controlled by electronic control unit 701. Electronic control unit 701 may control an opening degree of electronic expansion valve 700 based on the calculated super heat degree of the refrigerant flowing into the compressor or flowing out of evaporator unit 300.

The super heat degree is calculated based on the temperature of the low pressure side refrigerant. The temperature of the low pressure side refrigerant is detected by a temperature sensor 702. The temperature sensor may be disposed in at least one of outlet 241, pipe 262 or fins 219.

Electronic control unit 701 may use the refrigerant flow rate in the refrigerant cycle to estimate the super heat degree. The refrigerant flow rate is detected by a refrigerant flow rate sensor 703, which may be disposed in the outlet side of the compressor.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claim is:

1. An evaporator unit comprising:

an evaporator defining a refrigerant flow passage, an inlet port of the refrigerant flow passage and an outlet port of the refrigerant flow passage;

an internal heat exchanger defining a high pressure flow passage into which high pressure refrigerant flows, and a low pressure flow passage into which low pressure refrigerant from the outlet port of the evaporator flows; and an expansion device connected downstream of the high pressure flow passage of the internal heat exchanger and upstream of the inlet port of the evaporator, wherein the internal heat exchanger and the evaporator are integrated to create one assembly; wherein the evaporator comprises a first tank, a second tank, and a plurality of tubes which interconnect the first tank and the second tank;

the plurality of tubes define a heat exchange surface along their longitudinal length;

the internal heat exchanger is attached to a side surface of the evaporator, the side surface of the evaporator is perpendicular to the heat exchange surface; and the internal heat exchanger resides over the first tank and the second tank.

2. The evaporator unit according to claim 1, wherein both the inlet port and the outlet port of the refrigerant flow passage are disposed on the side surface of the evaporator.

3. The evaporator unit according to claim 2, wherein the inlet port and the outlet port are both disposed toward the first tank.

4. The evaporator unit according to claim 1, wherein:

the expansion device is a thermostatic expansion device having a temperature sensing element and a diaphragm, and the temperature sensing element is attached to the outlet port of the low pressure flow passage of the internal heat exchanger.

5. The evaporator unit according to claim 4, wherein the thermostatic expansion device further defines, a chamber accommodating the diaphragm, and means for connecting the temperature sensing element and the chamber.

6. The evaporator unit according to claim 5, wherein the evaporator unit further comprises a means for insulating heat between the internal heat exchanger and the means for connecting the temperature sensing element and the chamber.

7. The evaporator unit according to claim 1, wherein:

the expansion device is an electronic expansion device controlled by an electronic control device, and the electronic control device controls the electronic expansion device based on refrigerant temperature.

8. An evaporator unit comprising:

an evaporator defining a refrigerant flow passage, an inlet port of the refrigerant flow passage and an outlet port of the refrigerant flow passage;

an internal heat exchanger defining a high pressure flow passage into which high pressure refrigerant flows, and a low pressure flow passage into which low pressure refrigerant from the outlet port of the evaporator flows; and an expansion device connected downstream of the high pressure flow passage of the internal heat exchanger and upstream of the inlet port of the evaporator, wherein the internal heat exchanger and the evaporator are integrated to create one assembly; wherein the internal heat exchanger further comprises a connecting tank which is divided into a first connecting space and a second connecting space by a division wall, wherein:

the first connecting space communicates with the high pressure flow passage, the second connecting space communicates with the low pressure flow passage, and one of the high pressure flow passage and the low pressure flow passage penetrates the other's connecting space and the division wall to reach its respective connecting space.

9. A heat exchanger comprising:

a first refrigerant flow passage;

a second refrigerant flow passage disposed adjacent to the first refrigerant flow passage;

a connecting tank which is divided into a first connecting space and a second connecting space by a division wall, wherein:

the first connecting tank space communicates with the first refrigerant flow passage;

the second connecting tank space communicates with the second refrigerant flow passage, and the second refrigerant flow passage penetrates the first connecting space and the division wall to reach the second connecting space.

* * * * *